US009327341B2

(12) United States Patent
Ing

(10) Patent No.: US 9,327,341 B2
(45) Date of Patent: May 3, 2016

(54) METHOD OF FABRICATING INTEGRALLY BLADED ROTOR AND STATOR VANE ASSEMBLY

(71) Applicant: PRATT & WHITNEY CANADA CORP., Longueuil (CA)

(72) Inventor: Visal Ing, Ste-Julie (CA)

(73) Assignee: PRATT & WHITNEY CANADA CORP. LLP, Longueuil, Quebec (CA)

( * ) Notice: Subject to any disclaimer, the term of this patent is extended or adjusted under 35 U.S.C. 154(b) by 80 days.

(21) Appl. No.: 14/108,465

(22) Filed: Dec. 17, 2013

(65) Prior Publication Data

US 2014/0101939 A1 Apr. 17, 2014

Related U.S. Application Data

(62) Division of application No. 13/188,516, filed on Jul. 22, 2011, now Pat. No. 8,631,577.

(51) Int. Cl.
*B21D 53/78* (2006.01)

(52) U.S. Cl.
CPC ..... *B21D 53/78* (2013.01); *Y10T 29/4932* (2015.01); *Y10T 29/49316* (2015.01); *Y10T 29/49321* (2015.01); *Y10T 29/49336* (2015.01)

(58) Field of Classification Search
CPC ..... B21D 53/78; Y10T 29/49336; Y10T 29/49321; Y10T 29/4932; Y10T 29/49316
See application file for complete search history.

(56) References Cited

U.S. PATENT DOCUMENTS

| | | | |
|---|---|---|---|
| 3,890,062 | A | 6/1975 | Hendrix et al. |
| 5,021,941 | A | 6/1991 | Ford et al. |
| 5,047,966 | A | 9/1991 | Crow et al. |
| 5,282,261 | A | 1/1994 | Skeirik |
| 5,286,947 | A | 2/1994 | Clyde et al. |
| 5,369,870 | A | 12/1994 | Ouchi et al. |
| 5,428,201 | A | 6/1995 | Kaneko et al. |
| 5,521,847 | A | 5/1996 | Ostrowski et al. |
| 5,523,953 | A | 6/1996 | Araie et al. |
| 5,571,426 | A | 11/1996 | Akemura |
| 5,649,063 | A | 7/1997 | Bose |
| 5,664,066 | A | 9/1997 | Sun et al. |
| 5,831,407 | A | 11/1998 | Ouchi et al. |
| 5,981,965 | A | 11/1999 | Pryor et al. |
| 6,471,474 | B1 | 10/2002 | Mielke et al. |
| 6,478,539 | B1 | 11/2002 | Trutschel |
| 6,524,070 | B1 | 2/2003 | Carter |
| 6,850,874 | B1 | 2/2005 | Higuerey et al. |
| 6,890,150 | B2 | 5/2005 | Tomberg |
| 6,905,310 | B2 | 6/2005 | Kawamoto et al. |
| 6,912,446 | B2 | 6/2005 | Wang et al. |
| 7,099,737 | B2 | 8/2006 | Suh et al. |

(Continued)

FOREIGN PATENT DOCUMENTS

| | | |
|---|---|---|
| WO | 93/23820 | 11/1993 |
| WO | 2009/106830 | 9/2009 |

*Primary Examiner* — Richard Chang
(74) *Attorney, Agent, or Firm* — Norton Rose Fulbright Canada LLP

(57) ABSTRACT

A method of fabricating an integrally bladed rotor of a gas turbine engine according to one aspect, includes a 3-dimensional scanning process to generate a 3-dimensional profile of individual blades before being welded to the disc of the rotor. A blade distribution pattern on the disc is then determined in a computing process using data of the 3-dimensional profile of the individual blades such that the fabricated integrally bladed rotor is balanced.

6 Claims, 5 Drawing Sheets

(56) References Cited

U.S. PATENT DOCUMENTS

| | | | | |
|---|---|---|---|---|
| 7,117,115 | B2 | 10/2006 | Beignon et al. | |
| 7,206,717 | B2 | 4/2007 | Hardy | |
| 7,261,500 | B2 * | 8/2007 | Killer et al. | 409/132 |
| 7,301,165 | B2 | 11/2007 | Hu et al. | |
| 7,327,857 | B2 | 2/2008 | Lloyd, Jr. et al. | |
| 7,366,583 | B2 | 4/2008 | Burgess et al. | |
| 7,377,037 | B2 | 5/2008 | Ouellette et al. | |
| 7,399,159 | B2 | 7/2008 | Matheny et al. | |
| 7,451,639 | B2 | 11/2008 | Goldfine et al. | |
| 7,472,478 | B2 | 1/2009 | Graham et al. | |
| 7,559,728 | B2 | 7/2009 | Meier et al. | |
| 7,578,164 | B2 | 8/2009 | Sherlock et al. | |
| 7,591,078 | B2 | 9/2009 | Crampton | |
| 7,634,854 | B2 | 12/2009 | Meier | |
| 7,637,010 | B2 | 12/2009 | Burgess et al. | |
| 7,689,003 | B2 | 3/2010 | Shannon et al. | |
| 7,704,021 | B2 | 4/2010 | Hollmann et al. | |
| 7,774,157 | B2 | 8/2010 | Bouron et al. | |
| 7,779,695 | B2 | 8/2010 | Clossen-von Lanken Schulz et al. | |
| 7,797,828 | B2 | 9/2010 | Beeson et al. | |
| 7,809,523 | B2 | 10/2010 | Hunter et al. | |
| 7,840,367 | B2 | 11/2010 | Little et al. | |
| 7,877,223 | B2 * | 1/2011 | Lee et al. | 702/150 |
| 7,992,761 | B2 | 8/2011 | Baumann et al. | |
| 8,100,655 | B2 | 1/2012 | Stone et al. | |
| 8,103,375 | B2 | 1/2012 | Ouellette et al. | |
| 8,221,087 | B2 * | 7/2012 | Schreiber | 416/241 A |
| 8,602,722 | B2 * | 12/2013 | George et al. | 415/118 |
| 2005/0004684 | A1 | 1/2005 | Cribbs | |
| 2008/0105094 | A1 | 5/2008 | McMurtry et al. | |
| 2008/0250659 | A1 | 10/2008 | Bellerose et al. | |
| 2009/0282680 | A1 | 11/2009 | Kappmeyer et al. | |
| 2010/0023157 | A1 | 1/2010 | Burgess et al. | |
| 2011/0180521 | A1 | 7/2011 | Qoitter et al. | |
| 2012/0138586 | A1 | 6/2012 | Webster et al. | |

* cited by examiner

METHOD OF FABRICATING INTEGRALLY BLADED ROTOR AND STATOR VANE ASSEMBLY

CROSS REFERENCED TO RELATED APPLICATION

The present application is a divisional application of U.S. patent application Ser. No. 13/188,516 filed on Jul. 22, 2011, the entire content of which is herein incorporated by reference.

TECHNICAL FIELD

The invention relates generally to gas turbine engines and more particularly, to an improved method of fabricating integrally bladed rotors and stator vane assemblies of a gas turbine engine.

BACKGROUND OF THE ART

Integrally bladed rotors (IBR's), also commonly known as "bladed discs", are important parts of gas turbine engines. An IBR generally has a disc with an array of blades affixed thereto. The blades extend radially outwardly and are circumferentially spaced apart. The airfoil surfaces of each blade define a complex geometry to provide the desired aerodynamics. IBR's are used in gas turbine engines as compressor rotors or turbine rotors which rotate at high speeds during engine operation and therefore need to be accurately balanced to avoid generating vibration forces. However, fabricating IBR's is a challenging task and a centre of gravity of a fabricated IBR sometimes is not within an acceptable limit with respect to the rotating axis of the engine. Therefore, post-fabrication balancing activities are usually necessary for fabricated IBR's to ensure the IBR's rotate smoothly when installed in gas turbine engines. Nevertheless, the post-fabrication balancing activities of IBR's may be time consuming, causing increases to the cost of manufacturing gas turbine engines.

Accordingly, there is a need to provide an improved method of fabricating IBR's to reduce post-fabrication balancing activities of IBR's.

SUMMARY

In one aspect, the described subject matter provides a method of fabricating an integrally bladed rotor of a gas turbine engine, the integrally bladed rotor including a disc with an array of airfoil blades welding affixed to the disc, the method comprising a) electronically scanning each of the blades and disc to capture geometric data representative of a 3-dimensional profile of the individual blades; b) sing the geometric data to calculate a weight and center of gravity of each blade; c) using the calculated weight and center of gravity data to determine a blade array pattern on the disc; and d) positioning and welding the respective blades onto the disc in accordance with the determined blade array pattern.

In another aspect, the described subject matter provides a method of fabricating an integrally bladed rotor of a gas turbine engine, the integrally bladed rotor including a disc with an array of blades affixed to the disc, the blades extending radially outwardly and being circumferentially spaced apart, the method comprising a) operating a milling machine to cut a blank of the integrally bladed rotor secured in a device for ensuring a machining position, thereby forming the integrally bladed rotor having the blades extending from the disc to be fabricated; b) scanning the fabricated integrally bladed rotor to generate a complete 3-dimensional profile of the integrally bladed rotor before removing the integrally bladed rotor from the device; c) calculating a center of gravity of the integrally bladed rotor and verifying whether or not the center of gravity is within an acceptable range with respect to a reference point of the integrally bladed rotor; and d) removing the integrally bladed rotor from the device if the verification has a positive result.

In a further aspect, the described subject matter provides a method of fabricating a stator vane assembly of a gas turbine engine, the stator vane assembly including coaxial inner and outer rings with an array of stator vanes circumferentially spaced apart and radially extending between the inner and outer rings, the method comprising a) electronically scanning each of the stator vanes to capture geometric data representative of a 3-dimensional profile of the individual stator vanes; b) determining a stator vane array pattern between the inner and outer rings of the assembly to be fabricated, using the geometric data of the individual stator vanes in a computing process, the determined stator vane array pattern having openings between trailing edges of the stator vanes adapted to uniformly direct fluid flow; and c) positioning and welding the respective stator vanes between the inner and outer rings in accordance with the determined stator vane array pattern.

Further details of these and other aspects of the present invention will be apparent from the detailed description and figures included below.

DESCRIPTION OF THE DRAWINGS

Reference is now made to the accompanying drawings depicting aspects of the described subject matter, in which.

DETAILED DESCRIPTION

Figure 1:
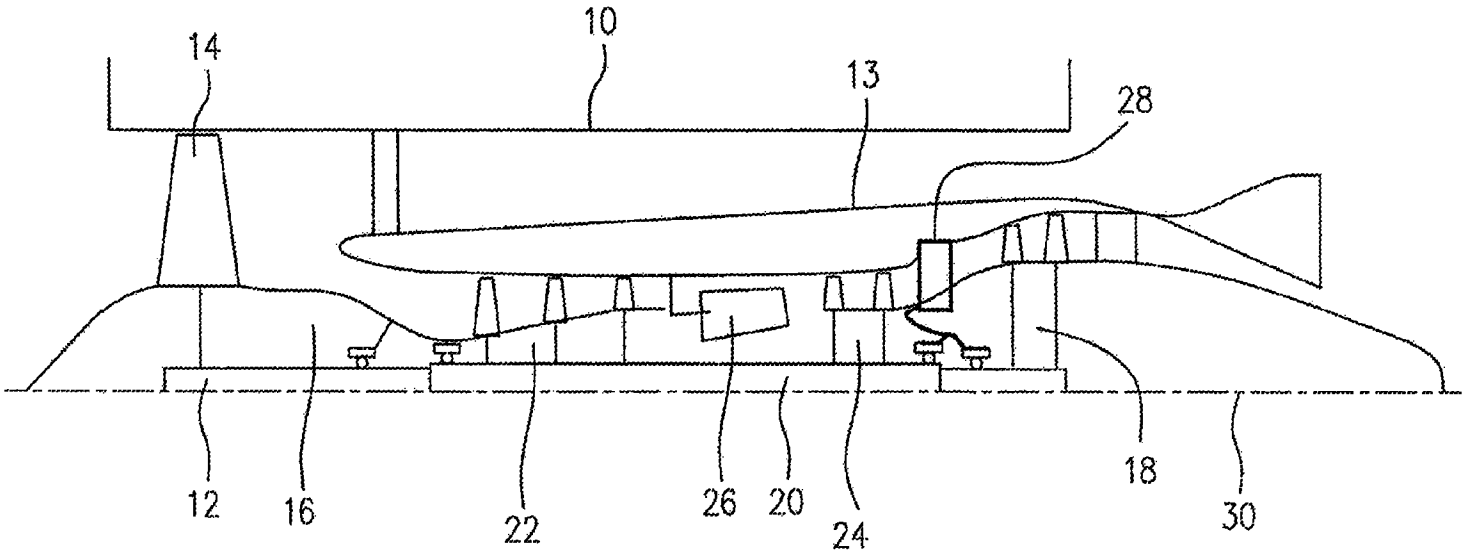
FIG. 1 is a schematic cross-sectional view of a turbofan gas turbine engine illustrating an exemplary application of the described subject matter.

Referring to FIG. 1, a turbofan gas turbine engine which is an exemplary application of the described subject matter includes a fan case 10, a core case 13, a low pressure spool assembly (not indicated) which includes a fan assembly 14, a low pressure compressor assembly 16 and a low pressure turbine assembly 18 connected by a shaft 12, and a high pressure spool assembly (not indicated) which includes a high pressure compressor assembly 22 and a high pressure turbine assembly 24 connected by a turbine shaft 20. The core case 13 surrounds the low and high pressure spool assemblies to define a main fluid path (not indicated) therethrough. The high and low pressure spool assemblies co-axially define a rotating axis 30 of the engine. A combustor 26 generates combustion gases in the main fluid path to power the high and low pressure turbine assemblies 24, 18 in rotation about the rotating axis 30. A mid turbine frame 28 is disposed between the high pressure turbine assembly 24 and the low pressure turbine assembly 18.

Figure 2:
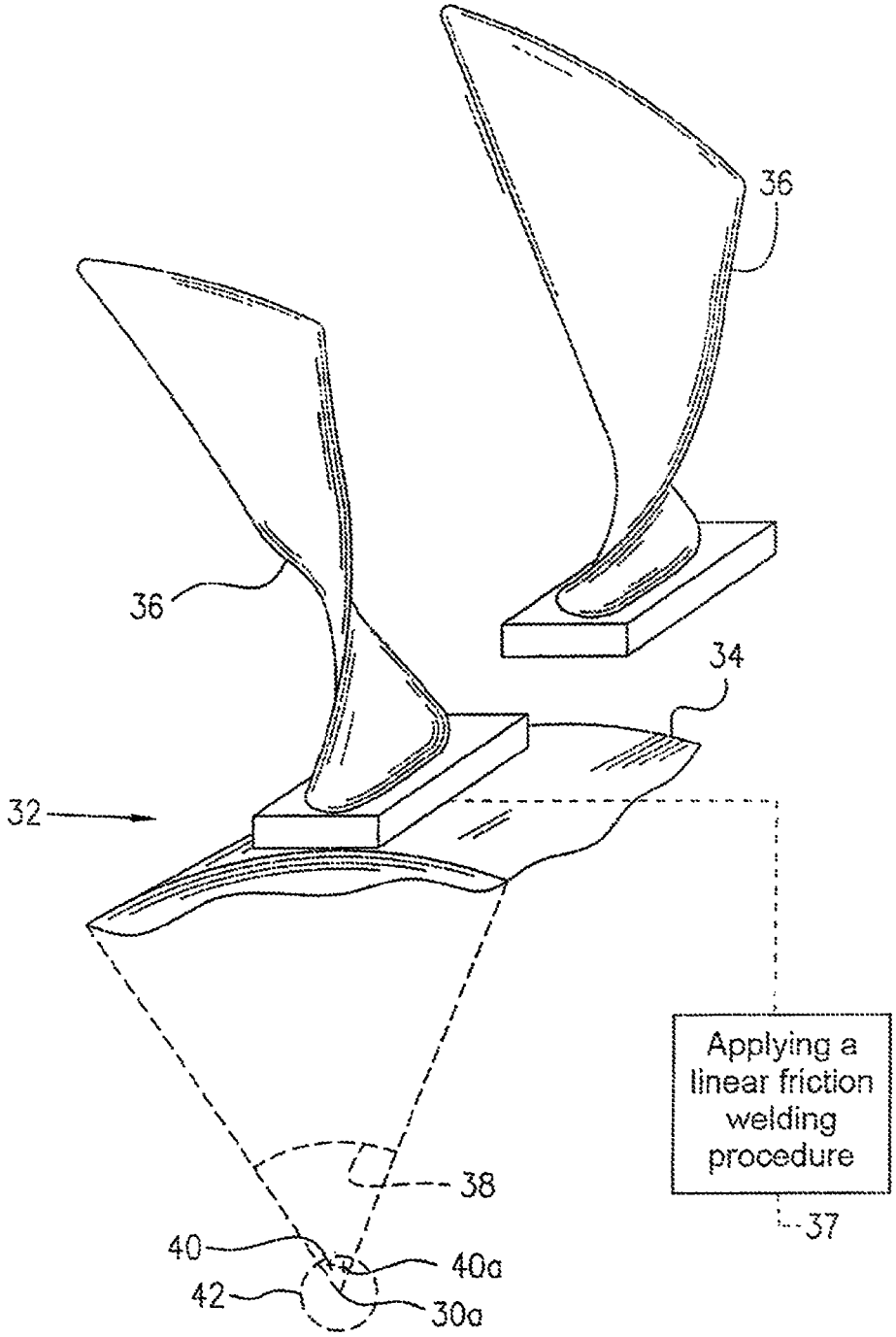
FIG. 2 is a partial perspective view of an integrally bladed rotor in fabrication, the individual blades of which have been 3-dimensionally scanned prior to a welding procedure, according to one embodiment.
Figure 5:
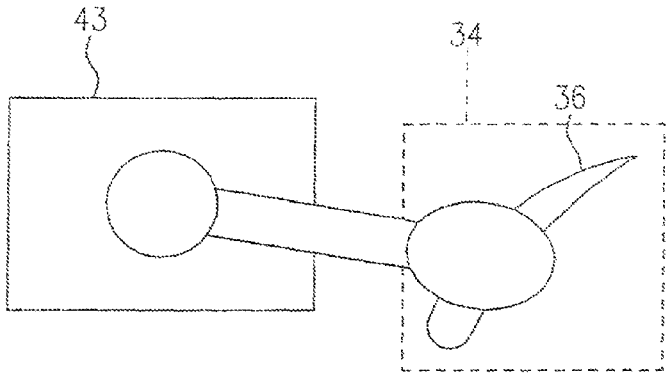
FIG. 5 is a schematic illustration showing a procedure of the individual blades to be welded to a disc of the integrally bladed rotor of FIG. 2 or the individual stator vanes to be welded to the rings of the stator vane ring assembly of FIG. 4 are scanned by a non-contact 3-dimensional scanning system.

Referring to FIGS. 1, 2 and 5, an integrally bladed rotor 32 is fabricated according to one embodiment for use as a rotor in any one of the fan assembly 14, low pressure compressor assembly 16, high pressure compressor assembly 22, the low pressure turbine assembly 18 and the high pressure turbine assembly 24 of the engine. The integrally bladed rotor 32 includes a disc 34 which is partially shown in FIG. 2, with an array of blades 36 affixed to the periphery of the disc 34 (only one blade shown being affixed to the disc). The blades 36 extend radially outwardly from the disc 34 and are circumferentially spaced apart one from another. The integrally bladed rotor 32 has a central hole which is partially shown in broken line 38, axially extending through the disc 34 for receiving the shaft 12 or 20 therein when the integrally bladed rotor 32 is installed in the engine. A well balanced integrally bladed rotor 32 when installed in the engine should have a center of gravity 40 located on the rotating axis 30 of the engine or within an acceptable range (which is exaggerated for the sake of illustration in FIG. 2, and is indicated by broken line 42) around the rotating axis 30 because the geometric center 30*a* of the central hole 38 in the disc 34, superposes the rotating axis 30 of the engine when the integrally bladed rotor 32 is installed in the engine, the center point 30*a* of the central hole 38 of the disc 34 is used as a reference point representing the rotating axis 30 of the engine before the integrally bladed rotor 32 is installed in the engine.

The disc 32 and the individual blades 36, according to one embodiment, are individually fabricated and are attached to the periphery of the disc 34 in a designed blade array pattern. The individual blades 36 are supposed to be accurately identical. However, producing perfectly identical blades is difficult to achieve in practice. As shown in FIG. 2, one of the blades 36 is positioned on the periphery of the disc 34 and another one of the blades 36 is about to be placed. A welding procedure such as a linear friction welding is applied along a joint area between the individual blades 36 and the disc 34, forming the integrally bladed rotor 32.

As above-discussed, it is desirable to have the center of gravity 40 of the integrally bladed rotor 32 within the acceptable range 42, with respect to the geometric center 30*a* of the central hole 38 of the disc 34. Due to the relative geometric simplicity of the disc 34, it may be assumed that the disc 32 is fabricated in a "perfect" condition such that a center of gravity of the disc 34 per se is located at the geometric center point 30*a* of the central hole 38 of the disc 34. Therefore, the location of the center of gravity of the integrally bladed rotor 32 is determined only by the arrangement of the blades 36 on the disc 34.

Due to the relatively complicated airfoil surfaces of the blades 36, the geometric data of the fabricated individual blades 36 may not be identical. Therefore, the individual fabricated blades 36, according to this embodiment are subjected to a 3-dimensional scanning procedure prior to the welding procedure as shown in FIG. 5, in order to generate a complete 3-dimensional profile and thus obtain complete geometric data of each of the individual blades 36.

FIG. 5 schematically illustrates a 3-dimensional scanning procedure in which a 3-dimensional scanning system 43 is employed to scan each of the blades 36 in order to generate a complete 3-dimensional profile of the individual blades 36 and thus obtain complete geometric data of the respective blades 36 prior to the blades 36 being welded to the disc 34. The 3-dimensional scanning system 43 may be a non-contact scanning system of various types such as laser triangulation, photogrammetry, white light, etc. The 3-dimensional scanning system 43 captures cloud points and recreates precisely, the actual 3-dimensional surfaces of each blade 36, thereby generating a complete 3-dimensional profile of each blade 36, and thus complete geometric data of each blade 36 including width, length, thickness, volume, etc. are available. The complete geometric data of the respective blades 36 together with the known properties of the material of the blade 36 such as weight per unit, etc., and the known geometric data of the "perfect" disc 34 are input into a computer system (not shown) and therefore, a blade array patterned on the disc 34 of the integrally bladed rotor 32 to be fabricated, can be determined in a computing process such that the blades 36 combined in the determined blade array pattern have a center of gravity (which is also the center of gravity 40 of the integrally bladed rotor 32 to be fabricated because of the presumed "perfect" disc 34) within the accepted range 42.

The next step is to physically position and weld the respective blades 36 on the disc 34 in accordance with the blade array pattern determined in the computing process, thereby forming the integrally bladed rotor 32 in a well balanced condition.

Some discs 34 may not be practically considered to be in a "perfect" condition because the center of gravity per se of the disc 34 is deviated from the geometric center point 30*a* of the central hole 38 of the disc 34. Therefore, the 3-dimensional scanning procedure as shown in FIG. 5 should alternatively also include scanning of the disc 34 before the welding procedure to also obtain complete geometric data of the disc 34. The computing process should be based on the geometric data of both the disc 34 and individual blades 36 as well as the known properties of the materials of the respective disc 34 and blades 36. The integrally bladed rotor 32 to be fabricated, in accordance with the blade array pattern determined in such a computing process, will have a center of gravity, for example indicated by the point 40*a* in FIG. 2, within the accepted range 42.

Figure 3:
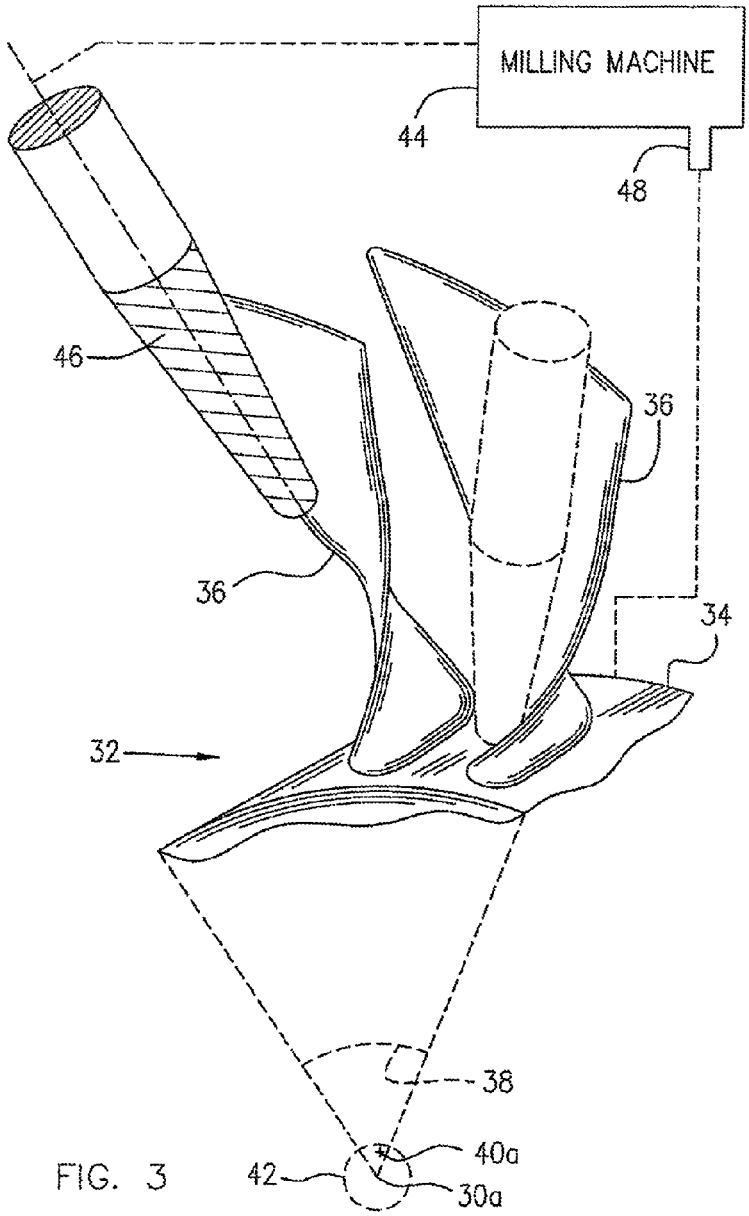
FIG. 3 is a partial perspective view of an IBR in a machining process, the machined integrally bladed rotor being subject to a 3-dimensional scanning procedure before being removed from the machine.
Figure 6:
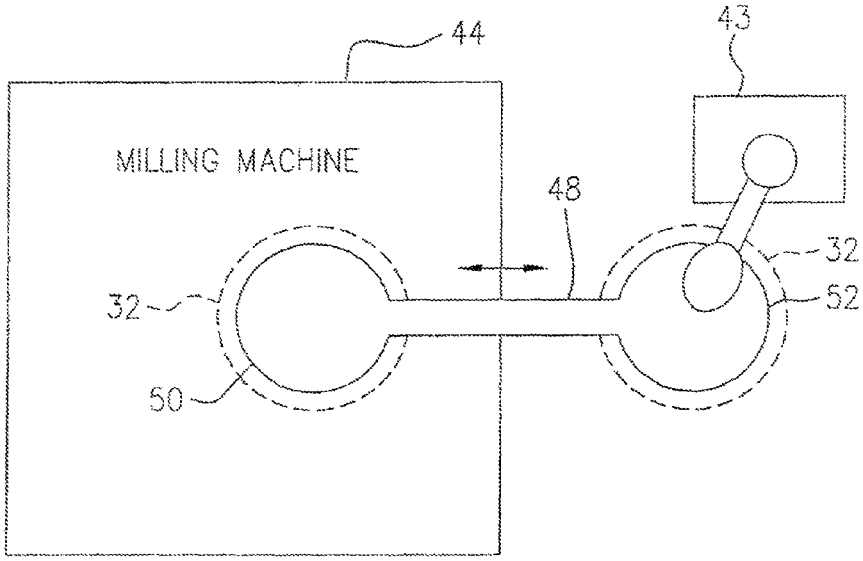
FIG. 6 is a schematic illustration showing the fabricated integrally bladed rotor of FIG. 3 undergoing a 3-dimensional scanning procedure before being removed from the machine.

Referring to FIGS. 3 and 6, the integrally bladed rotor 32 according to another embodiment, is fabricated in a machining operation. In contrast to welding the fabricated blades 36 to the periphery of the fabricated disc 32 as shown in FIG. 2, the integrally bladed rotor 32 as shown in FIG. 3, is fabricated in a machining process in which a cutter 46 of for example a milling machine 44, cuts a blank to form the integrally bladed rotor 32. The integrally bladed rotor 32 can be machined from a block or from a semi-fabricated blank which has been partially machined in a rough machining process. The integrally bladed rotor 32 is partially and schematically shown in FIG. 3 with two adjacent blades 36. The cutter shown in brokers lines (not indicated) illustrates a different machining step.

In the machining process, the formation of the individual blades 36 is completed together with the formation of the disc in one operation. Therefore, a 3-dimensional scanning procedure is applied to the entire integrally bladed rotor 32 rather than individually to the blades 36 and the disc 34. However, it should be noted that the 3-dimensional scanning process is conducted before, not after the fabricated integrally bladed rotor 32 is removed from the milling machine 44.

The machining process of the integrally bladed rotor 32 is conventional and will not be further described.

A palette changer system 48 may be provided as an integrated part of the milling machine 44 such that a blank of the integrally bladed rotor 32 to be placed on the milling machine 44 for a machining operation, is secured to the palette changer system 48 which is capable of moving the integrally bladed rotor 32 secured thereto, between a predetermined machining position 50 and a scanning position 52. In the predetermined machining position 50 the blank of the integrally bladed rotor 32 is machined to become a fabricated integrally bladed rotor 32. The fabricated integrally bladed rotor 32 is then, without being removed from the palette changer system 48 and thus from the milling machine 44, moved to the scanning position 52 wherein the 3-dimensional scanning system 43 which is similar to that used in the previously described embodiment, is employed to conduct a 3-dimensional scanning procedure to generate a complete 3-dimensional profile of the integrally bladed rotor 32 and thus create complete geometric data of the fabricated integrally bladed rotor 32.

The complete geometric data of the entire fabricated integrally bladed rotor 32 together with the known properties of the material of the integrally bladed rotor 32 is input into a computer system and therefore the accurate location of the center of gravity 40*a* of the fabricated integrally bladed rotor 32, can be accurately calculated.

The computer system also verifies whether or not the calculated location of the center of gravity 40*a* is within the accepted range 42 with respect to the geometric center point 30*a* of the central hole 38 of the disc 34. If the verification result is positive, the fabricated integrally bladed rotor 32 is removed from the milling machine 44 by being released from the palette changer system 48. If the verification result is negative, the fabricated integrally bladed rotor 32 is not removed from the palette changer system 44 but is moved back to the machining position 50 for a further machining procedure in which the fabricated integrally bladed rotor 32 is further machined accordingly and then the further machined integrally bladed rotor 32 is moved by the palette changer system 48 to the scanning position 52 again to receive the 3-dimensional procedure. A computing and verification step is conducted again based on the new data obtained from the scanning procedure of the further machined integrally bladed rotor 22, to determined whether or not the center of gravity 40*a* of the integrally bladed rotor 32 is now within the accepted range 42. These steps may be repeated until the fabricated integrally bladed rotor 32 is in a condition of receiving a positive verification result which means that the rotor 32 is well balanced.

It should be understood that it would be very difficult to accurately re-machine an unbalanced integrally bladed rotor 32 in order to achieve a well balanced condition if the lubricated integrally bladed rotor 32 has been removed from the machine to conduct the 3-dimensional scan and then the repositioned on the machine for a further machining process. The palette changer system 48 or any other device which is a part of the milling machine 44, has an affixed relationship with the milling machine, to ensure that the fabricated integrally bladed rotor 32 remains in the predetermined machining position 50 for re-machining alter being scanned in the scanning position 52, provided the fabricated integrally bladed rotor 32 has not been removed from and re-secured to the device. Therefore, it should be further noted that the integrally bladed rotor 32 is not removed form the milling machine if the integrally bladed rotor remains in and moves together with the palette changer system 48.

Figure 4:
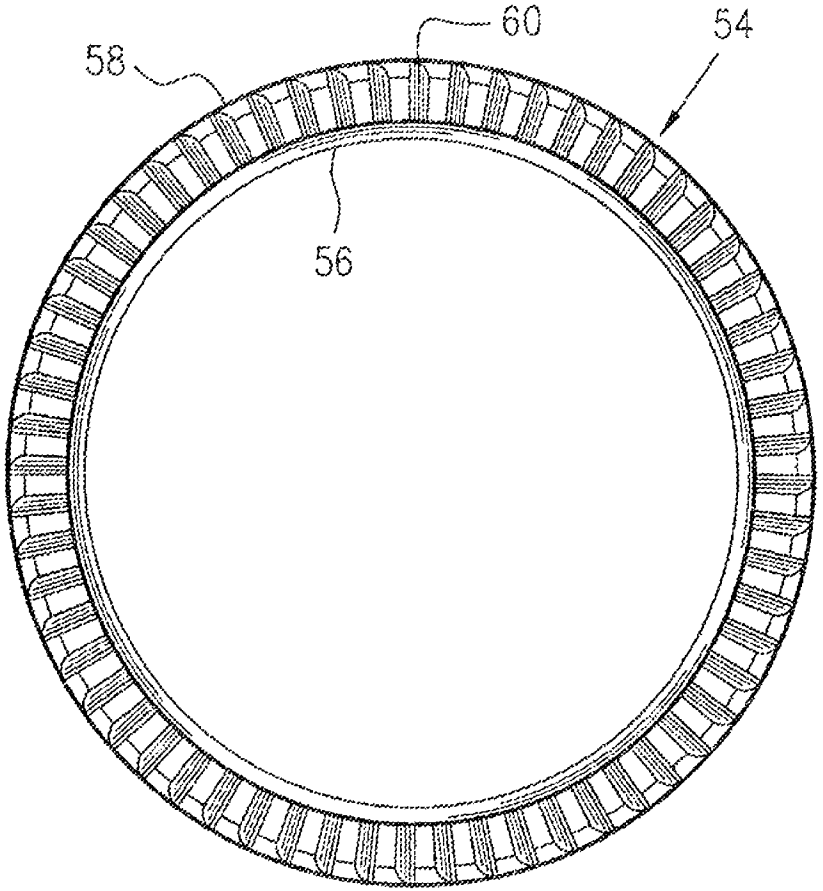
FIG. 4 is a rear elevational view of a stator vane ring assembly in which the individual stator vanes are 3-dimensionally scanned prior to a welding procedure, according to another embodiment.

Referring to FIGS. 1 and 4, the described method is also applicable to a fabricated stator vane ring assembly 54 which for example may be part of a mid turbine frame 28 positioned between the high pressure turbine assembly 24 and the low pressure turbine assembly 18 of the engine. The stator vane ring assembly 54 generally includes coaxially positioned inner and outer rings 56 and 58 with an array of stator vanes 60 circumferentially spaced apart and radially extending between the inner and outer rings 56 and 58. The stator vane ring assembly 54 is used in the main fluid path of the gas turbine engine for directing air flow into, for example the low pressure turbine assembly 18.

The stator vane ring assembly 54 is a stationary structure and as such, does not require an accurate location of the center of gravity thereof. However, the spacing between the stator vane trailing edges (not indicated) determines air flow through the stator vane ring assembly 54 and conventionally, the stator vane 60 trailing edges need to be "tweaked" (bent slightly) in a manual procedure to tune the individual openings (not indicated) between the stator vanes 60 in order to ensure uniform air flow through the stator vane ring assembly 54 around the circumference thereof.

Therefore, the fabricated individual stator vanes 60 according to this embodiment, are subject to a 3-dimensional scanning procedure similar to those described in the previous embodiments which will not be redundantly described herein. Based on such a 3-dimensional scanning procedure, the complete geometric data of the individual stator vanes 60 is available before the fabricated stator vanes 60 are welded to the respective inner and outer rings 56 and 58. Similar to the method described above, a stator vane array pattern can be determined in a computing process using the geometric data of the individual stator vanes acquired in the 3-dimensional scanning process, such that the computed stator vane array pattern provides openings between trailing edges of the stator vanes which are adapted to direct a uniform air flow.

Optionally, prior to the computing process in which the stator vane array pattern is determined, a selection of the fabricated stator vanes 60 may be conducted based on the obtained geometric data of the individual stator vanes 60 such that those stator vanes the shape of which is considered to be outside of shape tolerances may be removed and will not be used for the fabricated stator vane ring assembly 54 and can be replaced by new stator vanes which have been scanned and are proved to have an adequate shape.

The above description is meant to be exemplary only, and one skilled in the art will recognize that changes may be made to the embodiments described without departure from the scope of the invention disclosed. For example, the described method is not limited to any particular machine or device such as illustrated in the drawings. Still other modifications which fall within the scope of the present invention will be apparent to those skilled in the art, in light of a review of this disclosure, and such modifications are intended to fail within the appended claims.

The invention claimed is:

1. A method of fabricating an integrally bladed rotor of a gas turbine engine, the integrally bladed rotor including a disc with an array of blades affixed to the disc, the blades extending radially outwardly and being circumferentially spaced apart, the method comprising:

a) operating a milling machine to cut a blank of the integrally bladed rotor secured in a device for ensuring a machining position, thereby forming the integrally bladed rotor having the blades extending from the disc;

b) scanning the fabricated integrally bladed rotor to generate a complete 3 dimensional profile of the integrally bladed rotor before removing the integrally bladed rotor from the device;

c) calculating a center of gravity of the integrally bladed rotor based on the complete 3-dimensional profile of the integrally bladed rotor, and verifying whether or not the center of gravity is within an acceptable range with respect to a reference point of the integrally bladed rotor; and then d) removing the integrally bladed rotor from the device if the verification has a positive result.

2. The method as defined in claim 1 comprising further machining the fabricated integrally bladed rotor prior to step (d) if the verification in step (c) has a negative result and then repeating step (c).

3. The method as defined in claim 1 wherein step (b) is conducted with a non contact 3-dimensional scanning system.

4. A method of fabricating a stator vane assembly of a gas turbine engine, the stator vane assembly including coaxial inner and outer rings with an array of stator vanes circumferentially spaced apart and radially extending between the inner and outer rings, the method comprising:

a) electronically scanning each of the stator vanes to capture geometric data representative of a 3 dimensional profile of the individual stator vanes before the stator vanes are welded to the respective inner and outer rings;

b) determining a stator vane array pattern between the inner and outer rings of the assembly to be fabricated, using the geometric data of the individual stator vanes in a computing process, the determined stator vane array pattern having openings between trailing edges of the stator vanes adapted to uniformly direct fluid flow; and c) positioning and welding the respective stator vanes between the inner and outer rings in accordance with the determined stator vane array pattern.

5. The method as defined in claim 4 wherein step (a) is conducted with a non-contact 3-dimensional scanning system.

6. The method as defined in claim 4 further comprising replacing one or more stator vanes the shape of which is outside of shape tolerances according to the obtained geometric data, with one or more new stator vanes having desirable geometric data before step (b).

* * * * *